US008599098B1

(12) United States Patent
Marshall

(10) Patent No.: US 8,599,098 B1
(45) Date of Patent: Dec. 3, 2013

(54) ADJUSTABLE ANTENNA SYSTEM

(75) Inventor: Robert J. Marshall, Longmont, CO (US)

(73) Assignee: FIRST RF Corporation, Boulder, CO (US)

( * ) Notice: Subject to any disclaimer, the term of this patent is extended or adjusted under 35 U.S.C. 154(b) by 398 days.

(21) Appl. No.: 13/080,653

(22) Filed: Apr. 5, 2011

(51) Int. Cl.
*H01Q 1/12* (2006.01)

(52) U.S. Cl.
USPC ..... 343/888; 343/896

(58) Field of Classification Search
USPC ..... 343/888, 896, 898, 915
See application file for complete search history.

(56) References Cited

U.S. PATENT DOCUMENTS

| | | | | |
|---|---|---|---|---|
| 2,470,693 | A | 5/1949 | Finke et al. | |
| 2,536,733 | A | 1/1951 | Finke et al. | |
| 2,694,539 | A | 11/1954 | Finneburgh, Jr. et al. | |
| 3,624,662 | A * | 11/1971 | Feder | 343/715 |
| 3,977,005 | A | 8/1976 | Cejka | |
| 3,987,452 | A | 10/1976 | Godet | |
| 4,243,989 | A | 1/1981 | Piper | |
| 4,827,273 | A | 5/1989 | Friedberg et al. | |
| 5,157,410 | A | 10/1992 | Konishi | |
| 5,248,986 | A | 9/1993 | Marshall | |
| 6,853,340 | B2 | 2/2005 | Wang | |
| 6,975,178 | B1 * | 12/2005 | Kessler et al. | 333/105 |
| 8,018,387 | B2 * | 9/2011 | Kim et al. | 343/702 |
| 8,047,518 | B2 * | 11/2011 | Grange et al. | 269/289 MR |
| 2010/0066633 | A1 | 3/2010 | Singer | |

* cited by examiner

*Primary Examiner* — Ahshik Kim
(74) *Attorney, Agent, or Firm* — Christopher J. Kulish

(57) ABSTRACT

The present invention is directed to an antenna system comprising two rigid portions, an electrical conductor located between the two rigid portions, and a connector that extends between the two rigid portions and: (a) allows the position of one of the rigid portions relative to the other rigid portion to be altered when a force is applied to one of the rigid portions, such as when one of the rigid portions encounters an obstacle, and (b) maintains the altered position until a subsequent force is applied. In one embodiment, the connector comprises a ball-and-socket joint with the spring force produced by the socket causing sufficient frictional force between the ball and socket so that the position relationship of the ball to the socket is maintained when only gravity is being applied to the rigid portions and the connector but allowing the positional relationship to be altered when an additional force is applied. In another embodiment, the connector is comprised of multiple ball-and-socket links that each provide a limited angular range of motion and cumulatively allow an angular range of motion that is the sum of the limited angular ranges of motion associated each of the links.

17 Claims, 11 Drawing Sheets

ADJUSTABLE ANTENNA SYSTEM

FIELD OF THE INVENTION

The present invention relates to an antenna system and, more specifically, to an antenna system in which the relative positions of two rigid portions of the system can be adjusted.

BACKGROUND OF THE INVENTION

Generally, a radio system is comprised of a transmitter and/or receiver and an antenna system that is used to receive radio signals that are provided to a receiver and/or transmit radio signals produced by a transmitter. For convenience, the portion of a radio system comprised of a transmitter and/or receiver will hereinafter be referred to as a transceiver. In many situations, the relative positions of elements of the antenna system are static. For instance, commercial radio stations typically employ an antenna system that is situated on a geographical high point in the broadcast area. The positions of the elements of such an antenna system are substantially static. However, in many other situations, it is desirable to allow the relative positions of the elements of an antenna system to be altered to prevent damage to elements of the antenna system that could render the system inoperative. This is particularly so in portable radio system applications. For instance, it is not uncommon for a portion of an antenna system that extends away from a vehicle or a portion of an antenna system that extends away from the body of a foot soldier to encounter an obstacle that could damage the antenna system.

There are at least two approaches to allowing the relative relationships of elements of an antenna system to be altered. The first approach employs a spring that is interposed between two portions of an antenna system and, when one portion of the antenna system is engaged by a force, allows the relative positions of the two portions to be altered. When the position altering force is subsequently removed, the energy stored in the spring is used to return the portions of the antenna system to their original positions. The other approach is to provide a connector between the two portions of the antenna system that allows the relative positions of the two portions to be altered when one portion is engaged by a force. However, in this approach, the connector does not store any energy. So, when the force is no longer being applied to the engaged portion of the antenna system, the two portions of the antenna system do not return to their original positions but remain in whatever new relative positions resulted from the application of the force. A new force must be applied to return the portions of the antenna system to their original positions or to a different position from the original position or position resulting from the application of the force.

SUMMARY OF THE INVENTION

The present invention is directed to an antenna system that allows the relative positions of two portions of the system to be altered in response to a force being applied to at least one of the portions and that preserves the new relative positions after the application of the force is terminated.

In one embodiment, the antenna system is comprised of first and second substantially rigid portions, a flexible electrical conductor that extends between the portions, and a connector that extends from the first portion to the second portion. The connector maintains the positional relationship between two rigid portions when the only torque/force being applied is gravity but allows the positional relationship between the two rigid portions to be altered upon the application of an additional force. The connector includes a ball and a socket that are joined to one another so as to form a ball-and-socket joint. The joint maintains the positional relationship of the ball and socket to one another, as well as other elements of the system, provided the only force/torque being applied to the system is attributable to gravity. This positional relationship is maintained due to the frictional force between the interior surface of the socket and the portion of the exterior surface of the ball that is in engagement with the interior surface of the socket. This frictional force is achieved by establishing an interference fit between the ball and the socket. The joint, however, also needs to allow the relative positions of the two rigid portions of the system to be altered.

In one embodiment, the interference fit needs to: (a) maintain the relative positions of the two rigid portions when the only force/torque being applied to the system is attributable to gravity but allow the relative positions to be altered when an additional force/torque is applied, (b) be durable and/or abrasion resistant so that the ability to change the relative positions of the rigid portions can be maintained over numerous cycles, and (c) is a dielectric that has little, if any, effect upon the operation of active elements in the system. In one embodiment, this interference fit in this embodiment is achieved by employing a ball and socket in which the interior surface of the socket and the exterior surface of the ball that is capable of coming into contact with the interior surface of the socket are each realized by employing an ultra-high-molecular-weight polyethylene (UHMWPE), such as Lennite™ or Nylatron™ polyethylene. The socket and/or the ball can be produced by molding UHMWPE or machining a block of UHMWPE.

In another embodiment, the ball and socket of the joint define a passageway for accommodating at least a portion of the flexible electrical conductor located between the two rigid portions. The ball and socket each define a portion of the passageway. In a particular embodiment, the portion of the passageway defined by the ball includes a frusto-conical portion that, in combination with the portion of the passageway defined by the socket, allows the conductor to flex over a distance when the relative positions of the ball and socket change. This prevents the conductor from being bent around a sharp corner that could damage the conductor and/or unduly fatigue the conductor.

Another embodiment of the antenna system employs a connector that is comprised of several links, two end-links that each engage one of the rigid portions of the antenna and one or more intermediate links that are located between the end links. The end links can each be a ball without a socket (hereinafter referred to as a "ball end link") or a socket without a ball (hereinafter referred to as a "socket end link"). The intermediate link or links are each a rigid structure that is one of a ball-and-socket link, a socket-and-socket link, or a ball-and-ball link. In one embodiment, each of the end links is a ball end link that is suitable for establishing a ball-and-socket joint with an intermediate link that includes a socket. For example, a single socket-and-socket link can be used to link the ball end links to one another. In this case, two ball-and-socket joints are established, i.e., one ball-and-socket joint is established between one of the ball end links and one of the sockets of the socket-and-socket link and the other ball-and-socket joint is established between the other ball end link and the other socket of the socket-and-socket link. In another embodiment, one end link is a ball end link that is suitable for establishing a ball-and-socket joint with an intermediate link that includes a socket and the other end link is a socket end link that is suitable for establishing a ball-and-socket joint with an intermediate link that includes a ball. In this embodiment, a ball-and-socket link can be used to engage the two end links and, in so doing, establish two ball-and-socket joints. It should be appreciated that there can be more than one intermediate link. For instance, two ball-and-socket links can be engaged to one another such that the ball of one of the links engages the socket of the other link. In any event, combinations of end links and intermediate links can be used to establish one or more ball-and-socket joints that allow for the repositioning of the rigid portions of the antenna system. Further, because each ball-and-socket joint has a limited range of motion, a connector that employs a greater number of links will provide for greater flexibility in the positioning of the rigid portions of the system to one another. For example, if the range of motion of each ball-and-socket joint is limited to 22.5°, a connector with two ball-and-socket joints will limit that range over which the two rigid portions can be positioned relative to one another to 45°. However, a connector with four such ball-and-socket joints will allow the two rigid portions to move within a 90° range of one another, if needed or desired.

DETAILED DESCRIPTION

Figure 1:
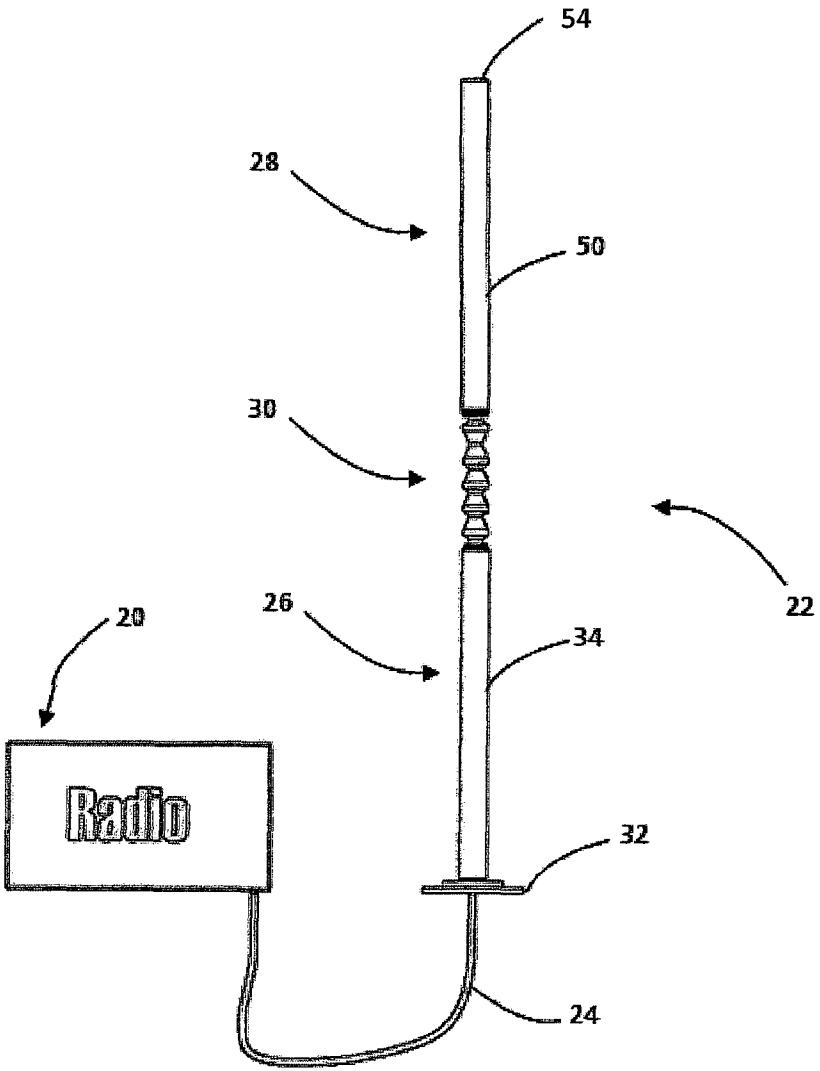
FIG. 1 illustrates a radio and an embodiment of an antenna system according to the present invention.

With reference to FIG. 1, a radio system is comprised of a radio 20 and an antenna system that is connected to the radio 20 and includes: (a) an antenna or antennas that are each capable of radiating an electro-magnetic signal and/or receiving a radiated electro-magnetic signal and (b) the structure for supporting and/or positioning and/or protecting the antenna or antennas.

With continuing reference to FIG. 1, an embodiment of an antenna system that maintains the relative positions of two rigid elements of the system when the only force/torque acting on the system is attributable to gravity but also allows the relative positions of the two rigid members to be altered by the application of an additional force/torque and remain in the altered position upon the termination of the addition force, hereinafter antenna system 22, is described. The antenna system 22 is used in conjunction with a radio 20. The radio 20 with which the antenna system 22 is used can be only a radio receiver, only a radio transmitter, or a radio transmitter and receiver (i.e., a transceiver). In the illustrated embodiment, the radio 20 and the antenna system 22 are separated from one another but connected to one another by an electrical conductor 24. The electrical conductor 24 can be a part of the radio 20 and include a connector that allows the remainder of the conductor to be connected to the antenna system 22, a part of the antenna system 22 and include a connector that allows the remainder of the conductor to be connected to the radio 20, or a separate part with connectors that allow the conductor to be connected to the radio 20 and to the antenna system 22.

Figure 2:
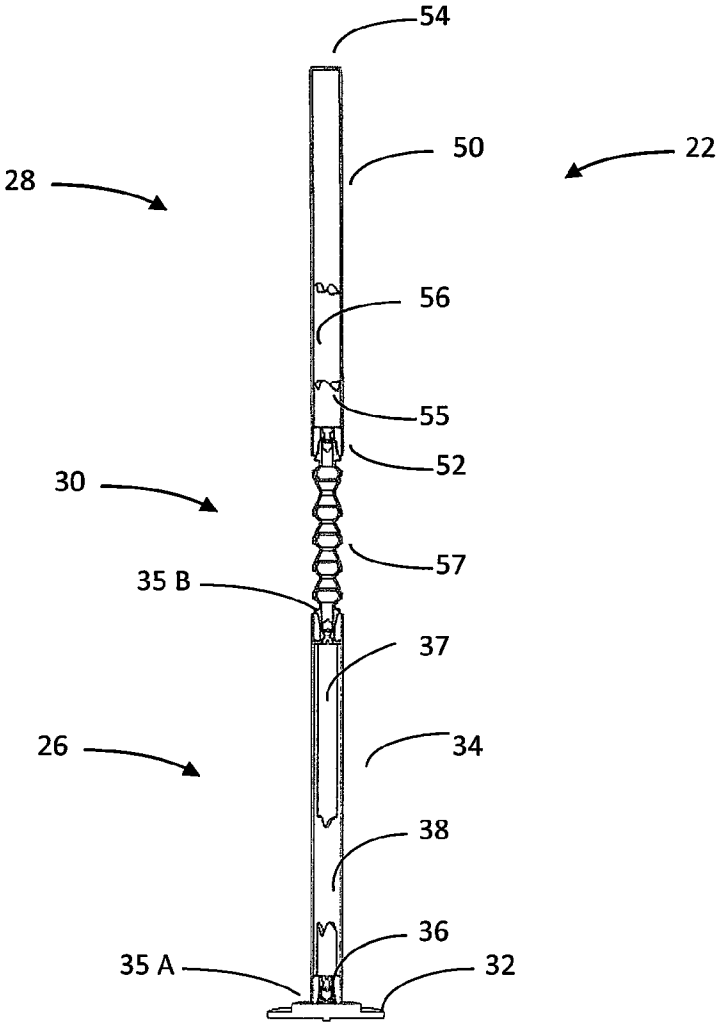
FIG. 2 is a cross-sectional view of the antenna system illustrated in FIG. 1.

With reference to FIGS. 1 and 2, the antenna system 22 is comprised of: (a) a first rigid portion 26, (b) a second rigid portion 28, and (c) a connector 30 for connecting the first rigid portion 26 and the second rigid portion 28 to one another. The first rigid portion 26 is comprised of a base plate 32 that is capable of being mounted to a flat surface, a tubular structure 34 with first and second open ends 35A, 35B, and a flange 36 that is connected to the base plate 32 and used to connect the base plate 32 to the tubular structure 34. The base plate 32, tubular structure 34, and flange 36 each define a portion of a passageway 38 that encloses an electrical conductor, antenna, and/or portion of an antenna. As such, the first rigid portion 26 provides: (a) a mounting surface for attaching the remainder of the first rigid portion 26 to another surface, (b) a structure for engaging the connector 30, (c) a structure that significantly determines the position of the second rigid portion 28, and (d) a protective conduit for any conductor, antenna, and/or portion of an antenna located within the passageway 38.

In many applications, the base plate 32, tubular structure 34, and flange 36 are made of a dielectric material so as to have little, if any, effect on the operation of the electrically active elements in the antenna system 22. In one embodiment, the tubular structure 34 is realized using polyvinylchloride (PVC) tubing and acts as a radome, the base plate 32 is made of PVC, and the flange 36 is made of PVC. The use of such plastics allows the base plate 32, tubular structure 34, and flange 36 to be joined to one another using any number of technologies known to those skilled in the art. For example, glue and/or melting/welding/soldering technologies can be used to connect the components to one another. The base plate 32, tubular structure 34, and flange 36 can each be realized using other materials known to those skilled in the art. If, however, any electrically conductive materials are utilized that will be electrically active when the system 22 is in use, the use of such materials will likely have to be taken into account in the design of the other active antenna elements. Further, other connection methodologies known to those skilled in the art can be employed. For example, the tubular structure 34 and flange 36 can be designed such that a friction or interference fit establishes a suitable connection. Additionally, a first rigid structure is feasible that employs molded or machined parts that reduce or eliminate the need to connect separate parts to one another to form the first rigid portion 26. For example, the molding of an integrated base plate and first tubular member is feasible and eliminates the need to connect multiple parts to one another to form the first rigid portion. As another example, a structure that is shared by the antenna system 22 and the radio 20 may provide as a suitable first rigid portion. For instance, a chassis or similar structure associated with the radio 20 may, in certain situations, serve as suitable a first rigid structure (i.e., when the radio and antenna are not to be meaningfully separated from one another).

While the base plate 32 is shown as having a flat surface that facilitates mounting the first rigid portion 24 to a flat surface, it should be appreciated that a base plate that facilitates mounting the first rigid portion to surfaces having different characteristics (e.g., a curved surface or a "keyed" surface that substantially reduces the possibility of slippage) is feasible. Additionally, the base plate 32 can be fastened to another surface using any appropriate fastening technology (e.g., glue, screw, clamp etc.). The base plate 32 can also be adapted to facilitate a particular fastening technology. For instance, the base plate can be adapted to include one or more slots that retain the straps of one or more hose/pipe clamps that are used to attach a base plate with a curved engagement surface to a tubular member.

The first rigid portion 26 also includes one or more electrically active elements 37 that are located in the passageway 38 or a portion of the passageway 38. For instance, an electrical conductor, antenna, and/or portion of antenna can be located in the passageway 38 or a portion of the passageway 38. If such an electrically active element is located in the passageway 38 and the element has a flexible nature (e.g., a coaxial cable), the first rigid portion 26 is still considered to be rigid due to the rigid nature of the base plate 32, the tubular structure 34, and/or the flange 36. The electrically active element(s) 37 is/are operatively connected (directly or indirectly) to the electrical conductor 24.

By placing one or more electrically active elements 37 in the passageway 38, the base plate 32, tubular structure 34, and flange 36 surround any such elements and substantially reduce the possibility of any such elements coming into contact with other objects or materials (e.g., water) that could damage the elements. However, in certain applications, the providing of a structure that surrounds any such electrically active elements may not be required. In such instances, the first rigid portion can be realized with a different structure. For instance, if the only electrically active element that is to be associated with the first rigid portion 26 is a coaxial cable that is substantially impervious to substances that are likely to be encountered and any objects that could damage the cable are likely to be situated in a limited angular range, a first rigid portion may include a section of PVC angle iron with the coaxial cable located between the legs of the PVC angle iron and the PVC angle iron oriented so as to protect the cable from objects in the limited angular range. Also, in certain applications, one or more of any electrically active elements may be rigid and robust enough that a surrounding or partially surrounding protective structure is not required to protect any such electrically active elements.

The second rigid portion 28 is comprised of a tubular structure 50 with an open end 52 and a closed end 54. The tubular structure 50 defines a passageway 56 that encloses an electrical conductor, antenna, and/or portion of an antenna. As such, the second rigid portion 28 serves to provide: (a) a structure for engaging the connector 30 and (b) a protective conduit for any conductor, antenna, and/or portion of an antenna located within the tubular structure 50. In many applications, the tubular structure 50 is made of a dielectric material so as to have little, if any, effect on the operation of the electrically active elements in the antenna system 22. In one embodiment, the tubular structure 50 is realized using polyvinylchloride (PVC) tubing and acts as a radome. The tubular structure 50 can be realized using other materials known to those skilled in the art. If, however, any electrically conductive material or materials are utilized and such materials will be electrically active during the operation of the system 22, the use of such materials will likely have to be taken into account in the design of the other active antenna elements. The second rigid portion 28 also includes one or more electrically active elements 55 that are located in the passageway 56. For instance, an electrical conductor, antenna, and/or portion of antenna can be located in the passageway 56. If such an electrically active element is located in the passageway 38 and the element has a flexible nature (e.g., a coaxial cable), the second rigid portion 28 is still considered to be rigid due to the rigid nature of the tubular structure 50. The electrically active element(s) 55 is/are operatively connected (directly or indirectly) to an electrical conductor 57 that is substantially located within the connector 30. The flexible electrical conductor 57 is also operatively connected (directly or indirectly) to the electrically active element(s) 37 and/or the electrical conductor 24.

By placing one or more electrically active elements 55 in the passageway 56, the tubular structure 50 surrounds any such elements and substantially reduce the possibility of any such elements coming into contact with other objects or materials (e.g., water) that could damage the elements. However, in certain applications, the providing of a structure that surrounds any such electrically active elements may not be required. In such instances, the first rigid portion can be realized with a different rigid structure, as noted with respect to the first rigid portion. As also noted with respect to the first rigid portion, in certain applications, one or more of any electrically active elements may be rigid and robust enough that a surrounding or partially surrounding protective structure is not required to protect any such electrically active elements.

Figure 3:
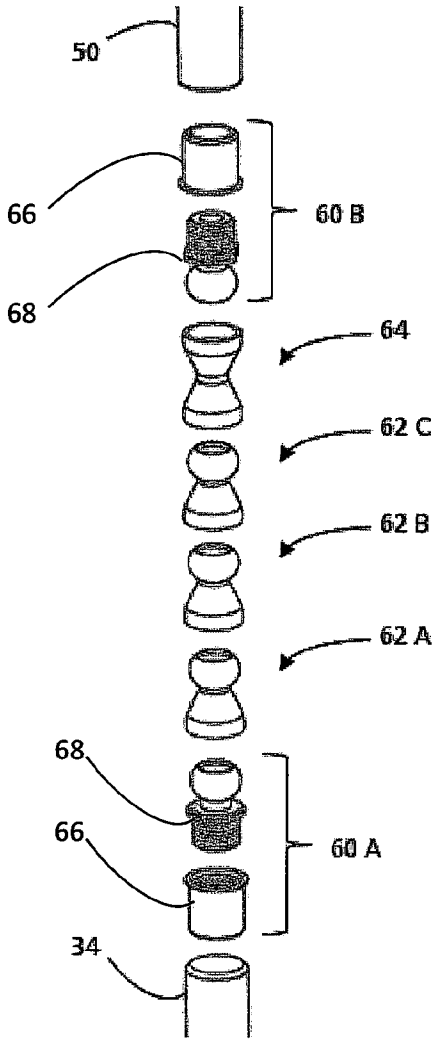
FIG. 3 is an exploded view of the connector portion of the antenna system shown in FIG. 1 without any electrically active antenna elements.

With reference to FIG. 3, the connector 30 is comprised of a first ball end link 60A, a second ball end link 60B, three intermediate ball-and-socket links 62A-62C, and one intermediate socket-and-socket link 64.

Figures 4A, 4B:
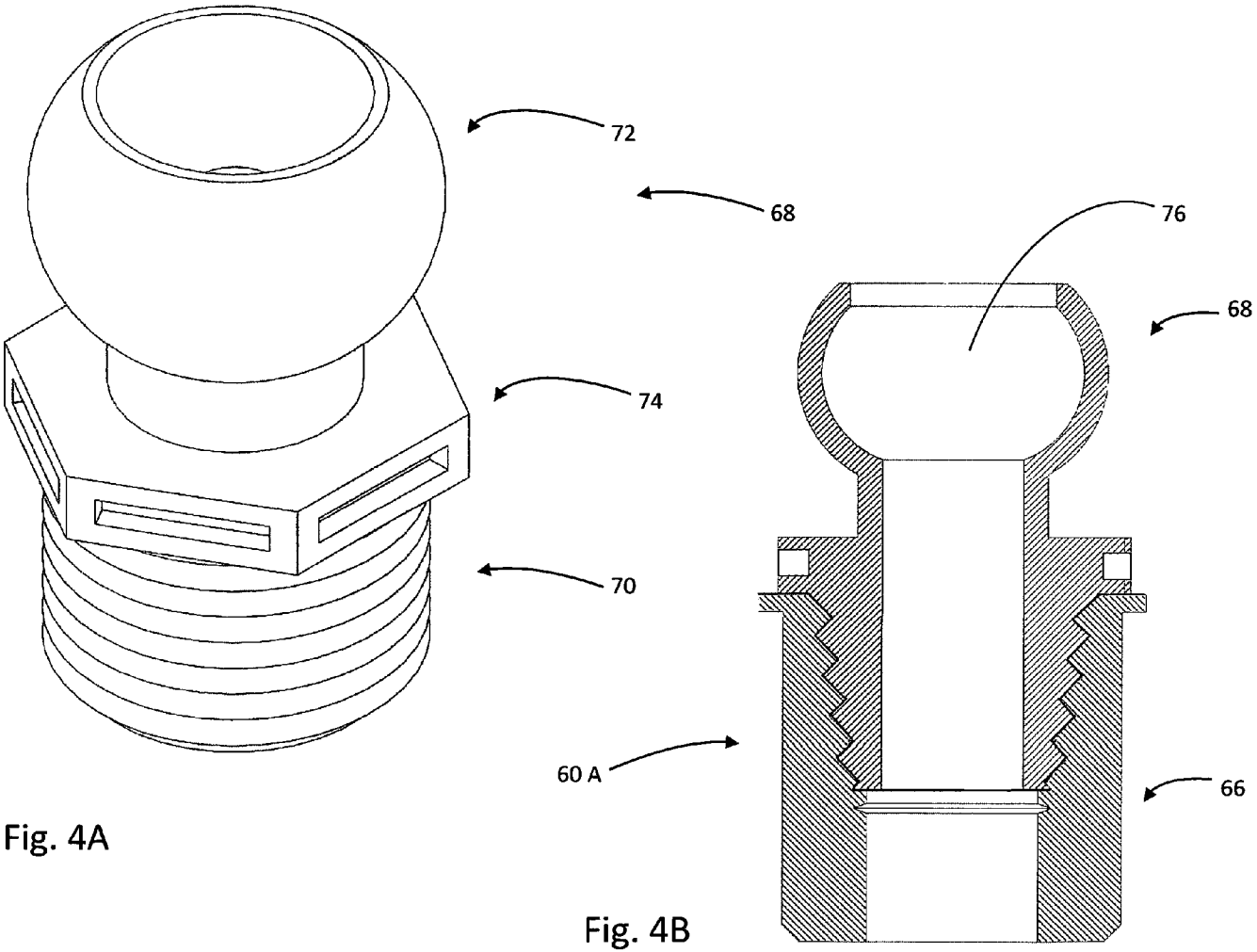
FIG. 4A illustrates the open-ended ball structure of a ball end link.
FIG. 4B is a cross-sectional view of a ball end link comprised of an open-ended plug and the open-ended ball structure shown in FIG. 4A.

The first ball end link 60A is adapted to engage the first tubular structure 34 and a socket associated with the intermediate ball-and-socket link 62A. In this regard and with reference to FIGS. 4A and 4B, the first ball end link 60A is comprised of: (a) an open-ended plug 66 with a threaded interior surface and an exterior surface sized to engage and be fixedly attached to the interior surface of the first tubular structure 34 and (b) an open-ended ball structure 68 with a threaded first end 70 for engaging the threaded interior surface of the plug 66, a ball end 72 for engaging a cooperating socket, and an intermediate portion 74 with a hexagonal exterior surface. The hexagonal exterior surface facilitates the use of a wrench to tighten and pre-load the connection between the threaded exterior surface of the ball structure 68 and the threaded interior surface of the plug 66. In this regard, the threads are tapered to allow a locking connection between the plug 66 and the ball structure 68 to be achieved. Other structures for connecting the ball structure 68 to the first tubular structure 34 are feasible. For instance, the interior of the first tubular structure 34 could be threaded for engaging the threaded exterior surface of the ball structure 68. Another possibility is to glue or weld the exterior of the ball structure to the interior of the first tubular structure 34 and thereby avoid the need for threads. With reference to FIG. 4B, the first ball end link 60A defines a passageway 76 for accommodating a flexible electrical conductor.

The second ball end link 60B is adapted to engage the second tubular structure 50 and a socket associated with the intermediate socket-and-socket link 64. The structure of the second ball end link 60B is substantially identical to that of the first ball end link 60A. As such, the structure of the second ball end link 60B is not described further.

Figure 5A:
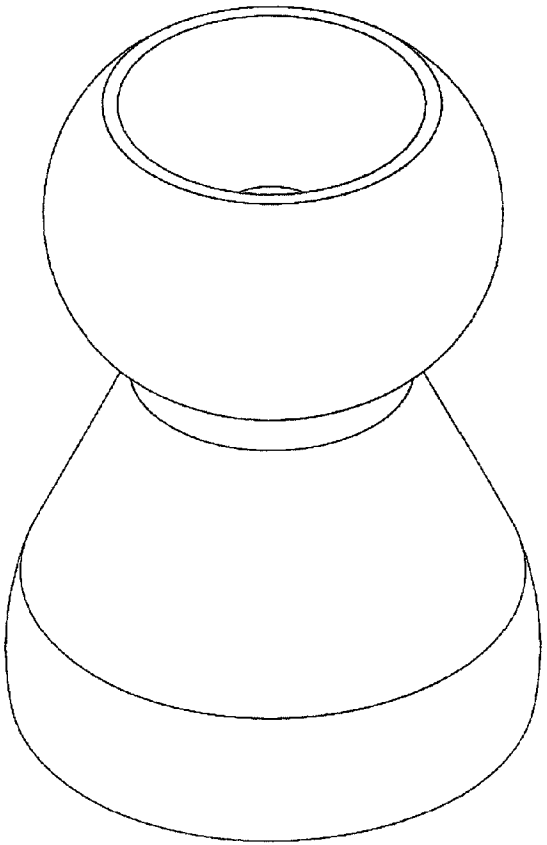
FIGS. 5A and 5B respectively illustrate a ball-and-socket link and a cross-sectional view of the ball-and-socket link.
Figure 5B:
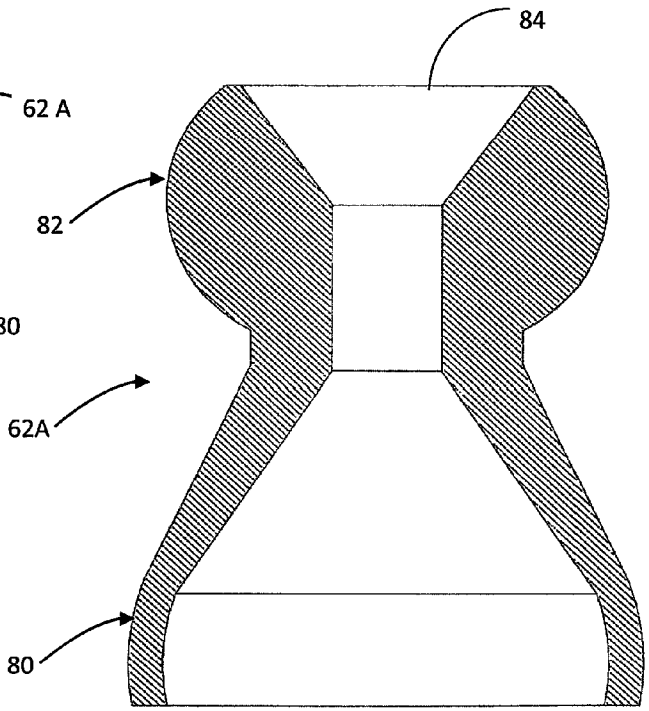

With reference to FIGS. 5A and 5B, the intermediate ball-and-socket link 62A is comprised of a socket structure 80 for engaging a cooperating ball and a ball structure 82 for engaging a cooperating socket. More specifically, the socket structure 80 is adapted to engage the ball structure 72 associated with the first ball end link 60A and the ball structure 82 is adapted to engage a socket structure associated with the intermediate ball-and-socket link 62B. The ball structure 82 and socket structure 80 are rigidly connected to one another. Typically, this is achieved by molding, casting or machining so that the link is realized from a single piece of material. Realizing a ball-and-socket link that is rigid can be achieved by other methods, including by the assembly or joining of multiple pieces. With reference to FIG. 5B, the intermediate ball-and-socket link 62A defines a passageway 84 for accommodating a flexible electrical conductor.

The intermediate ball-and-socket link 62B is adapted to engage the ball of the intermediate ball-and-socket link 62A and the socket of the intermediate ball-and-socket link 62C. Similarly, the intermediate ball-and-socket link 62C is adapted to engage the ball of the intermediate ball-and-socket link 62B and a socket of the intermediate socket-and-socket link 64. The structures of the intermediate ball-and-socket links 62B and 62C are substantially identical to that of intermediate ball-and-socket link 62A. Consequently, the structures of the links 62B and 62C are not described further.

Figure 6B:
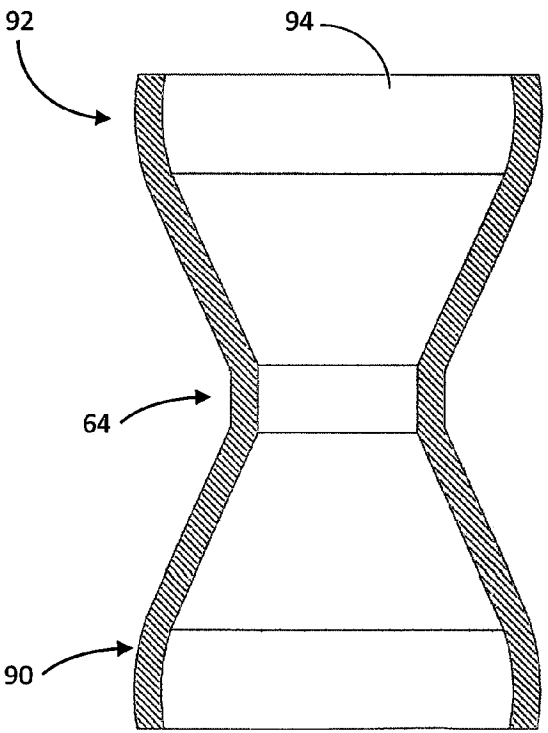
FIGS. 6A and 6B respectively illustrate a socket-and-socket link and a cross-sectional view of the socket-and-socket link.
Figure 6A:
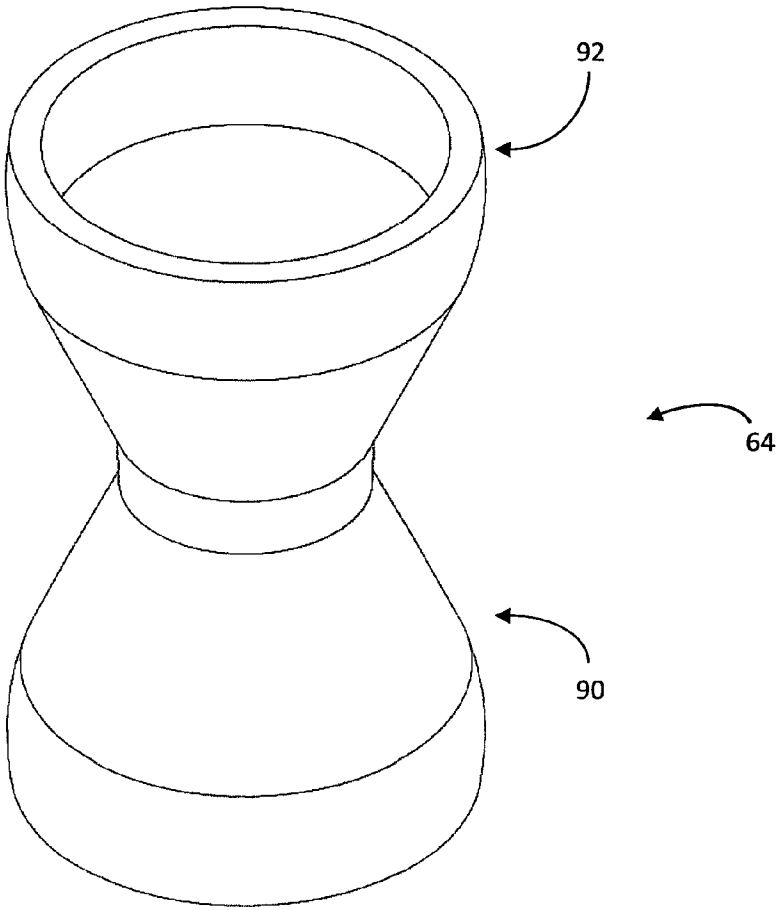

With reference to FIGS. 6A and 6B, the intermediate socket-and-socket link 64 is comprised of a first socket 90 for engaging a cooperating ball and a second socket 92 for engaging another cooperating ball. More specifically, the first socket 90 is adapted to engage the ball of the intermediate ball-and-socket link 62C and the second socket 92 is adapted to engage the ball of the ball end link 60B. The first socket 90 and the second socket 92 are rigidly connected to one another. Typically, this is achieved by molding, casting or machining so that the link is realized from a single piece of material. Realizing a socket-and-socket link that is rigid can be achieved by other methods, including by the assembly or joining of multiple pieces. With reference to FIG. 6B, the intermediate socket-and-socket link 64 defines a passageway 94 for accommodating a flexible electrical conductor.

Figure 7:
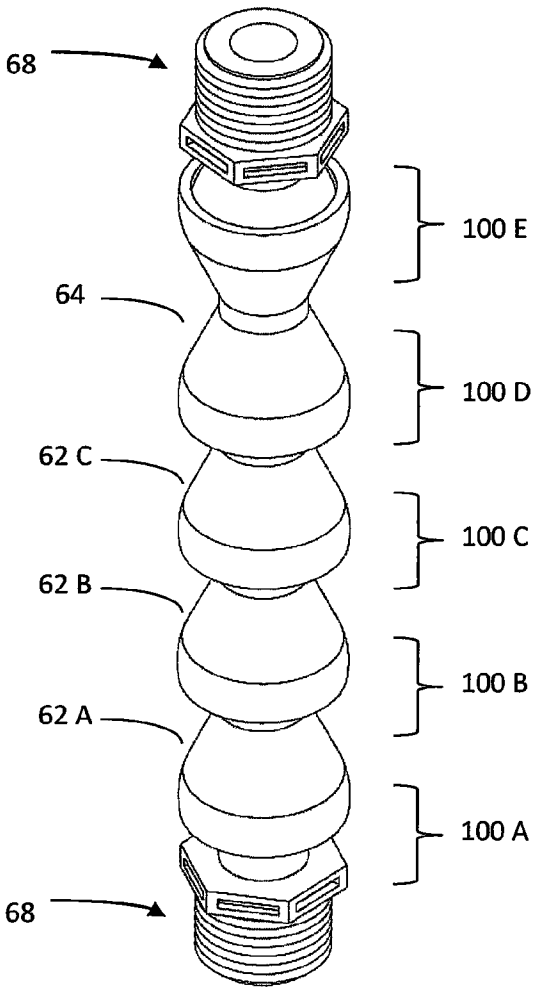
FIG. 7 illustrates the five ball-and-socket joints associated with the connector shown in FIG. 1.

Each of the links is used in establishing at least one ball-and-socket joint with an adjacent link. More specifically, the ball end links 60A, 60B are each used to establish a single ball-and-socket joint with the immediately adjacent intermediate link. Each of the intermediate ball-and-socket links 62A and the intermediate socket-and-socket link 64 is used to establish two ball-and-socket joints, one joint with the immediately adjacent link on one side of the intermediate link of interest and the other joint with the immediately adjacent link on the other side of the intermediate link of interest. With reference to FIG. 7, the connector 30 has five ball-and-socket joints 100A-100E.

Figure 8:
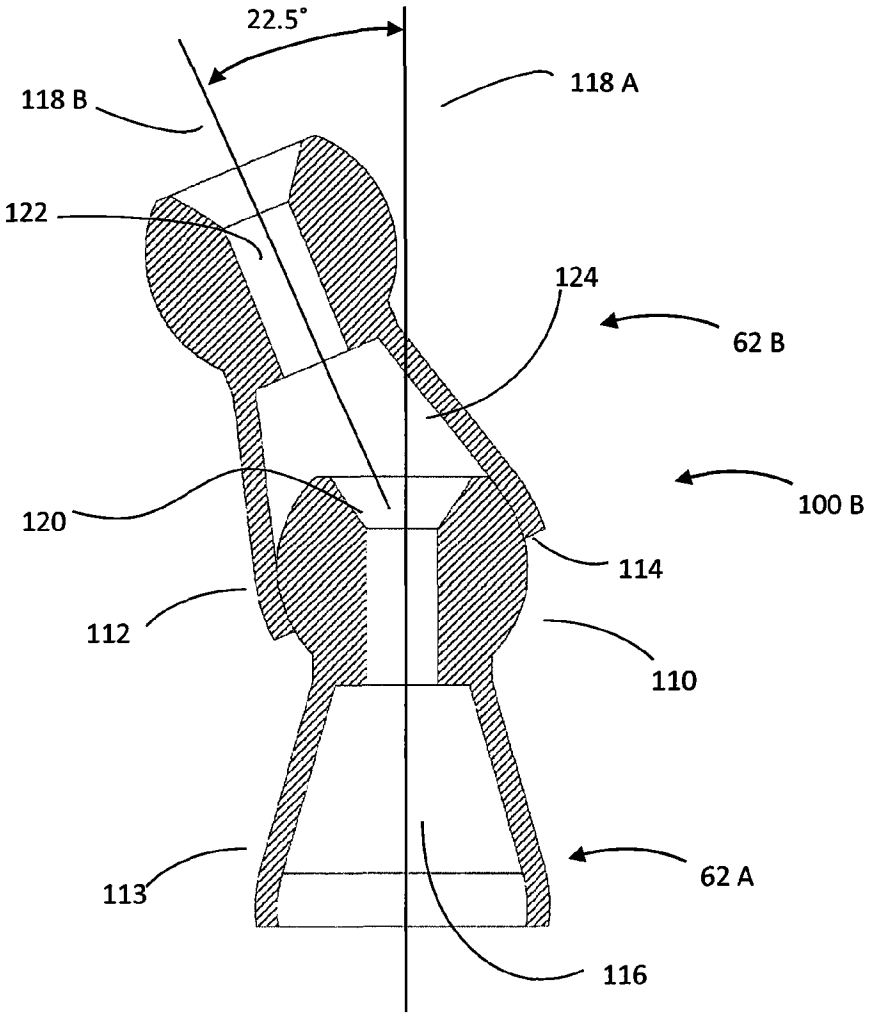
FIG. 8 illustrates a cross-section of a ball-and-socket joint established using two ball-and-socket links.

With reference to FIG. 8, the ball-and-socket joint 100B established between the intermediate ball-and-socket links 62A, 62B is described. The ball-and-socket joint 100B is comprised of the ball 110 of the intermediate ball-and-socket link 62A and the socket 112 of the intermediate ball-and-socket link 62B. To establish the ball-and-socket joint 100B, the ball 110 is inserted through the opening 114 defined by the edge of the socket 112. The opening 114 has a smaller diameter than the diameter of the ball 110. Further, the inner diameter of the socket 112 is slightly less than the diameter of the ball 110. As such, when the ball 110 is fully inserted into the socket 112, an interference fit is established between the ball 110 and the socket 112. The interference fit is designed so that there is sufficient friction between the ball 110 and the socket 112 to maintain the relative positions of the ball 110 and the socket 112 when (a) the maximum torque attributable solely to gravity and within the range of positions that the first and second rigid portions 26, 28 are expected to take in a particular application is applied to the joint and (b) a change in the relative positions of the ball and socket is possible. The greatest possible maximum torque is applied to the joint when: (a) the first rigid portion 26, second rigid portion 28, and connector 30 are aligned with one another, (b) the first rigid portion 26, second rigid portion 28, and connector 30 are oriented so as to be perpendicular to the gravity vector (i.e., positioned to extend horizontally), and (c) the system 22 is only supported by whatever structure the base 32 is attached to. If a particular application precludes or renders unlikely this orientation of the first and second rigid portions 26, 28 and the connector 30, the maximum torque is less. In any event, the interference fit is typically designed so as to maintain the relative positions of the ball 110 and the socket 112 when a force somewhat greater than the maximum torque for a particular application and attributable to gravity is applied to the joint. However, the interference fit is not designed so as to establish so much friction between the ball 110 and the socket 112 that the relative positions of the ball 110 and the socket 112 cannot be altered in appropriate circumstances. To elaborate, the interference fit is designed in the illustrated embodiment so that an individual can apply a force/torque to the joint (i.e., a force/torque that is in greater than the maximum torque for a particular application and resulting solely from the application of gravity) so that the relative positions of the ball 110 and the socket 112 can be altered. The greater force that is needed to alter the relative positions of the ball 110 and the socket 112 can be different depending on the application. It should be appreciated that this criteria is satisfied by each joint in the connector 30.

The establishment of sufficient friction between the ball 110 and the socket 112 to maintain the relative positions when the noted maximum torque is being applied to the system 22 but not so much friction that the relative positions cannot be altered by the application of force/torque to the joint that is sufficiently greater than the relevant maximum force/torque is achieved by using a material or combination of materials for the ball 110 and the socket 112 that have high tensile and compressive strengths and relatively low coefficients of friction. In the illustrated embodiment, one group of materials that meets these requires are ultra-high-molecular-weight-polyethylenes (UHMWPE). Examples of such UHMWPEs are the polyethylenes marketed under the Lennite™ and Nylatron™ marks. In the illustrated embodiment of the connector 30, each of the intermediate links and at least the open-ended ball structure of each of the ball end links are entirely made from a UHMWPE. The links can be made by casting, molding, or machining UHMWPE to achieve the desired shapes. It should be appreciated that other materials are capable of being used to realize the balls and sockets such that the desired interference fit is obtained. For instance, certain metals and metal alloys can be used to make the balls and sockets. For example, many types of coated metals can be used. The use of a metal or metal alloy to realize the balls and sockets is likely to increase the mass of the system 22 relative to the use of a UHMWPE. Further, the use of combinations of materials or pieces of materials to realize the balls and sockets is feasible. For instance, a metal with the appropriate tensile and compressive strengths but an undesirable coefficient of friction can be coated with a low friction material.

With continued reference to FIG. 8, due to the interference fit between the ball 110 and the socket 112, the structure of the socket 113 associated with the link 62A, and the need for a passageway 116 in the link 62A to accommodate a flexible electrical conductor, the range of motion of the joint is limited to 22.5°, i.e., the angle between the longitudinal axis 118A of the link 62A and the longitudinal axis 118B of the link 62B can be no greater than 22.5°. It should be appreciated that if one or more of the factors that are determinative of this range change, the range of motion may be increased or decreased. For instance, if a material can be utilized that allows the desired interference fit to be achieved but allows the wall that defines the portion of the passageway 116 adjacent to the socket 112 to be narrowed, the range of motion can likely be increased. Conversely, if a material is utilized that requires this wall to be made thicker, the range of motion is likely to decrease.

With continued reference to FIG. 8, the passageway 116 defined by the ball 110 has a frusto-conical portion 120. The side of the frusto-conical portion 120 is at an angle of 22.5° relative to the longitudinal axis 118A of the link 62A. As such, over the relative range of motion of 22.5° provided by the joint 100B, any electrical conductor that is passing through the passageway 116 of the link 62A, a passageway 122 of the link 62B, and an intermediate passageway 124 defined by the ball 110 and the socket 112 will not be subjected to a passageway of decreasing cross-sectional area that could cause the electrical conductor to have a bend with an undesirable bend radius, bind within the connector 30, be abraded or crimped, or substantially inhibit the joint 100B from providing the desired range of motion between the ball 110 and the socket 112. It should be appreciated that a frusto-conical portion could be associated with a passageway associated with a socket of a ball-and-socket joint rather than with the ball of such a joint. However, this is likely to require changes in the structure of the link that would adversely affect the range of motion of the joint. As an alternative to the use of a passageway with a frusto-conical portion, a cylindrical passageway with a larger diameter can be utilized. However, this may also require other changes to the link that would adversely affect the range of motion of the joint and/or compromise the tensile and compressive strength aspects of the portion of the joint through which the larger diameter passageway passes.

The other ball-and-socket joints 100A and 100C-100E are substantially identical to the ball-and-socket joint 100B. Consequently, these other joints will not be further described.

The connector 30 is comprised of six links (60A, 60B, 62A-62C, and 64) from which the five ball-and-socket joints 100A-100E are realized. Each joint provides a range of motion of approximately 22.5°. Cumulatively, the joints 100A-100E provide a range of motion between the first rigid portion 26 and the second rigid portion 28 of approximately 112.5°. It should be appreciated that other combinations of ball end links and intermediate links can be used to produce a connector that provides a different range of motion between the first and second rigid portions. For instance, a connector with two ball end links that are connected to one another by a socket-and-socket link has two ball-and-socket joints. Assuming that each of the joints has a range of motion of 22.5°, the connector provides a range of motion of 45° between the first and second rigid portions.

Figure 9B:
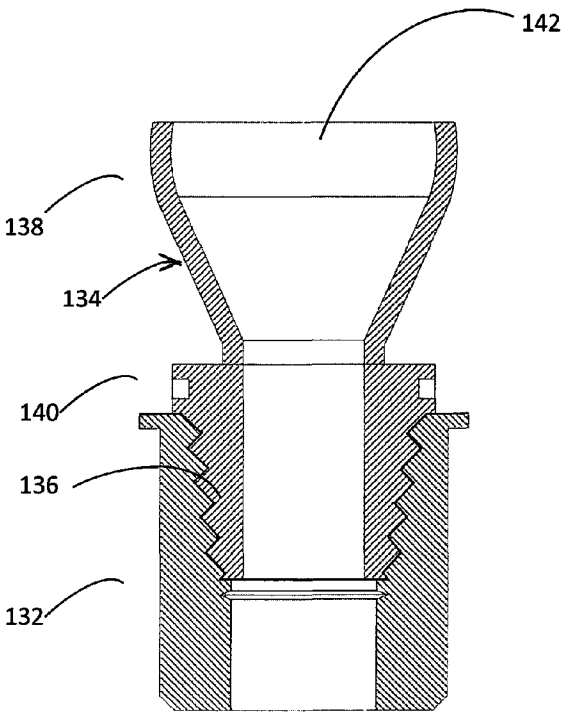
FIGS. 9A and 9B respectively illustrate a socket end link and a cross-sectional view of the socket end link.
Figure 9A:
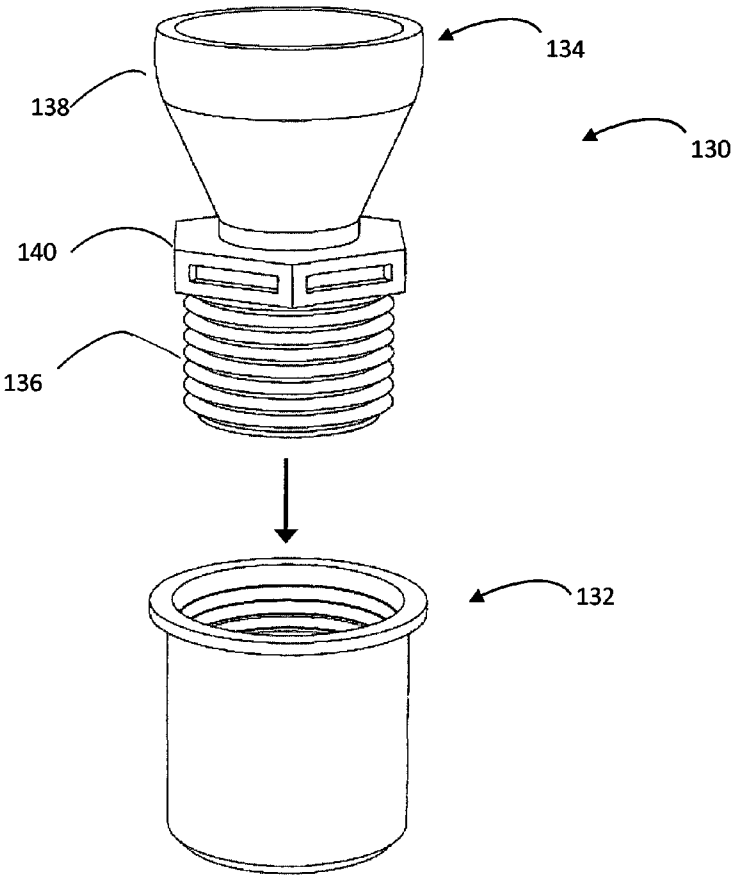

It should be appreciated that the types of link are not limited to ball end links, ball-and-socket links, and socket-and-socket links. With reference to FIGS. 9A and 9B, a socket end link 130 is also feasible. The socket end link 130 is adapted to engage a tubular structure, such as tubular structure 34 or tubular structure 50, and a ball associated with a ball end link or with an intermediate link that includes a ball. In this regard, the socket end link 130 is comprised of: (a) an open-ended plug 132 with a threaded interior surface and an exterior surface sized to engage and be fixedly attached to the interior surface of a tubular structure and (b) an open-ended socket structure 134 with a threaded first end 136 for engaging the threaded interior surface of the plug 132, a socket end 138 for engaging a cooperating ball via an interference fit, and an intermediate portion 140 with a hexagonal exterior surface. The hexagonal exterior surface facilitates the use of a wrench to tighten and pre-load the connection between the threaded exterior surface of the socket structure 134 and the threaded interior surface of the plug 132. In this regard, the threads are tapered to allow a locking connection between the plug 132 and the socket structure 134 to be achieved. Other structures for connecting the socket structure 134 to a tubular structure, as noted with respect to the ball end link 60A, are feasible. With reference to FIG. 9B, the socket end link 130 defines a passageway 142 for accommodating a flexible electrical conductor.

Figure 10B:
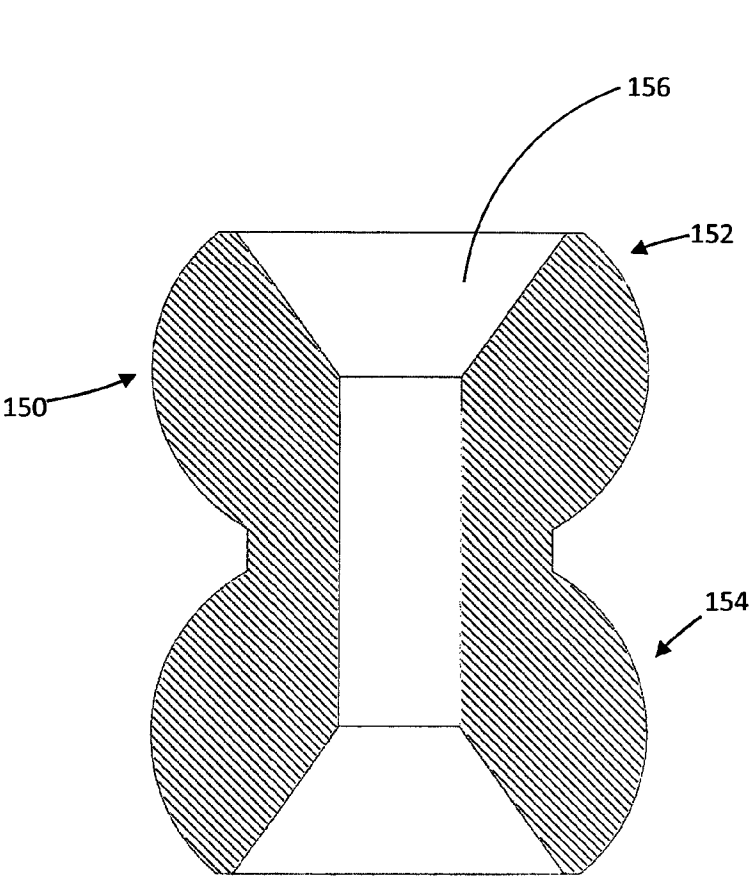
FIGS. 10A and 10B respectively illustrate a ball-and-ball link and a cross-sectional view of the ball-and-ball link.
Figure 10A:
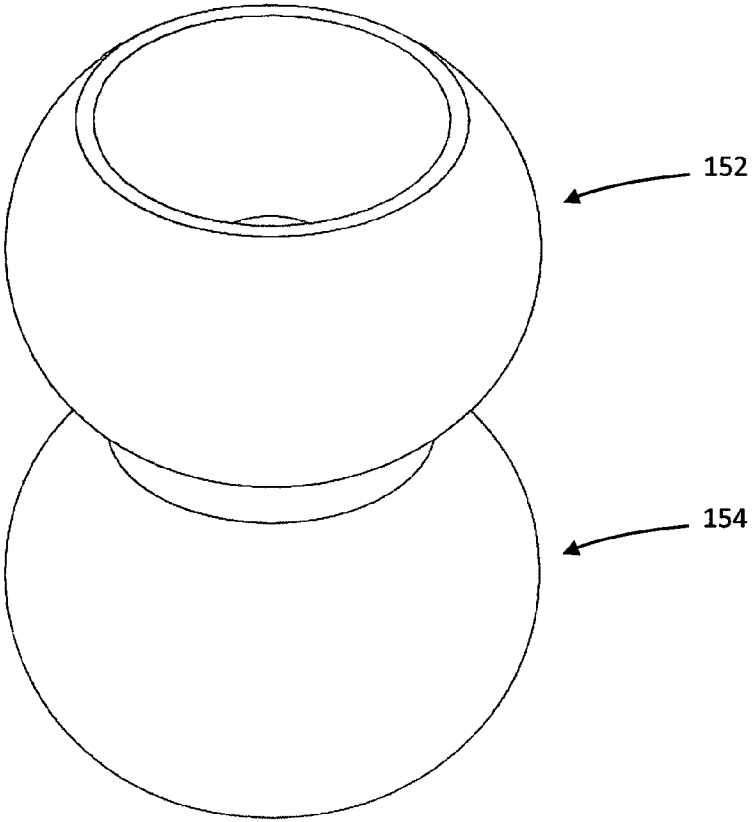

With reference to FIGS. 10A and 10B, an intermediate ball-and-ball link 150 is also feasible. The intermediate ball-and-ball link 150 is comprised of a first ball 152 for engaging a cooperating socket and a second ball 154 for engaging another cooperating socket. More specifically, the first and second balls 152, 154 are each adapted to engage, via an interference fit, a socket associated with any end link or intermediate link that has a socket. The first ball 152 and the second 154 are rigidly connected to one another. Typically, this is achieved by molding, casting or machining so that the link is realized from a single piece of material. Realizing a ball-and-ball link that is rigid can be achieved by other methods, including by the assembly or joining of multiple pieces. With reference to FIG. 10B, the intermediate ball-and-ball link 150 defines a passageway 156 for accommodating a flexible electrical conductor.

As should be appreciated, a connector for connecting the first rigid portion 26 and the second rigid portion 28 must include two end links. The two end links can be two ball end links, two socket end links, or a ball end link and socket end link. The connector can also include one or more intermediate links with each link being one of a ball-and-socket link, a ball-and-ball link, or a socket-and-socket link. A connector with only one ball-and-socket joint is realized by connecting a ball end link to a socket end link. A connector with two or more ball joints is established by using two end links and one or more intermediate links. While there is no upper limit on the number of links that can be employed in a connector, it is considered unlikely that a connector that provides a range of motion of greater than 180° will be needed. Further, it should also be appreciated that it is likely to become more difficult to maintain the positions of the first and second rigid portions of the antenna system when the system is being subjected to a force/torque that is solely attributable to gravity or to a somewhat greater force depending upon the application as the number of joints in a connector increases. It should also be appreciated that an antenna system with three or more rigid portions and connectors that each have two or more links and extend between immediately adjacent pairs of the rigid portions is feasible.

Figure 11C:
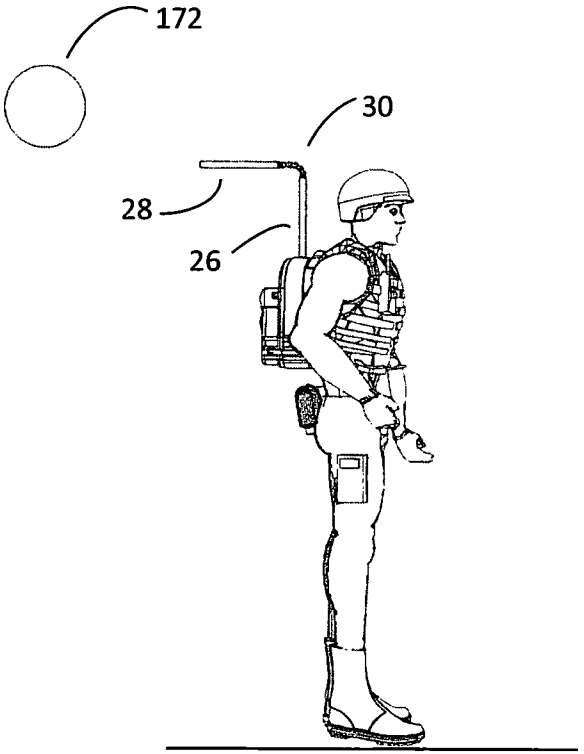
FIGS. 11A-11C illustrates the antenna system of FIG. 1 associated with a foot soldier and the response of the antenna system when one of the rigid portions of the antenna system is engaged by an overhanging obstacle in the foot soldier's path.
Figure 11B:
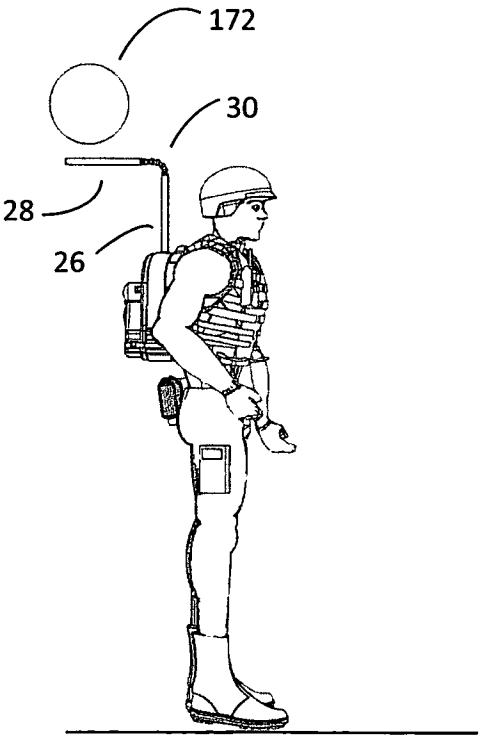
Figure 11A:
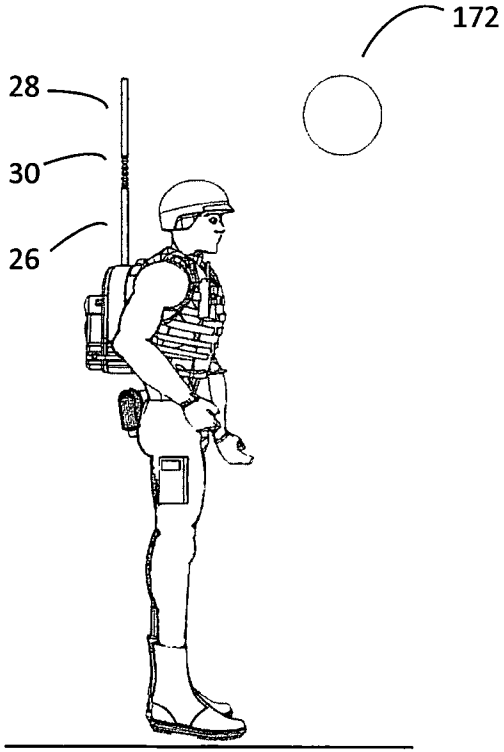

With reference to FIGS. 11A-11C, an example of the operation of the antenna system 22 is described. Generally, the antenna system 22 is associated with a foot soldier 170. In FIG. 11A, the antenna system 22 is in a state in which the first rigid portion 26, second rigid portion 28, and connector 30 are substantially vertically disposed and the foot solder is walking towards an overhead obstacle 172. In FIG. 11B, the foot solder 170 is passing under the obstacle and the second rigid portion 28 of the antenna system is engaged by the overhead obstacle 172. The engagement of the second rigid portion 28 by the overhead obstacle 172 causes a force/torque that is sufficiently greater than the maximum force/torque associated with at least one of the joints of the connector 30. In response to this greater force/torque, the antenna system 22 allows the relative positions of the first and second rigid portions to be altered such that there is roughly a 90° angle between the first and second rigid portions 26, 28. With reference to FIG. 11C, after the foot solder 170 has passed under the obstacle 172 and the second rigid portion 28 is no longer being engaged by the obstacle 172 and substantially only gravity is being applied to the system 22, the system 22 operates so that the roughly 90° angle between the first and second rigid portions 26, 28 is maintained. This positional relationship will be maintained until such time as a sufficient force/torque is applied to the second rigid portion 28.

The foregoing description of the invention is intended to explain the best mode known of practicing the invention and to enable others skilled in the art to utilize the invention in various embodiments and with the various modifications required by their particular applications or uses of the invention.

What is claimed is:

1. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

the ball-and-socket joint defining a passageway for enclosing a portion of the flexible electrical conductor;

wherein the passageway having a frusto-conical portion.

2. An antenna system, as claimed in claim 1, wherein:

the ball of the ball-and-socket joint has an exterior surface that defines the circular base of the frusto-conical portion of the passageway.

3. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

wherein the ball of the ball-and-socket joint has a ball exterior surface that is less than the exterior surface of a sphere having a radius equal to the radius of the ball.

4. An antenna system, as claimed in claim 3, wherein:

the first rigid antenna portion comprises one of: (a) a base suitable for mounting on a supporting structure (b) a radome, and (c) an antenna.

5. An antenna system, as claimed in claim 3, wherein:

the second rigid antenna portion comprises one of: (a) a radome and (b) an antenna.

6. An antenna system, as claimed in claim 3, wherein:

the connector is a dielectric.

7. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

wherein the connector comprises a ball-and-socket link with a ball and a socket that are connected to one another so as to form a rigid structure; and the ball-and-socket link defining a passageway for enclosing a portion of the flexible electrical conductor.

8. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

wherein the connector comprises a ball-and-ball link with a first ball and a second ball that are connected to one another so as to form a rigid structure; and the ball-and-ball link defining a passageway for enclosing a portion of the flexible electrical conductor.

9. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

wherein the connector comprises a socket-and-socket link with a first socket and a second socket that are connected to one another so as to form a rigid structure; and the socket-and-socket link defining a passageway for enclosing a portion of the flexible electrical conductor.

10. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

wherein the connector comprises a first ball link that is located between the first rigid antenna portion and the remainder of the connector and a second ball link that is located between the second rigid antenna portion and the remainder of the connector;

the first and second ball links each defining a passageway for enclosing a portion of the flexible electrical conductor.

11. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

wherein the connector comprises a first socket link that is located between the first rigid antenna portion and the remainder of the connector and a second socket link that is located between the second rigid antenna portion and the remainder of the connector;

the first and second socket links each defining a passageway for enclosing a portion of the flexible electrical conductor.

12. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

wherein the connector comprises a socket link that is located between one of the first and second rigid antenna portions and the remainder of the connector and a ball link that is located between one of the first and second rigid antenna portions and the remainder of the connector;

the socket and ball links each defining a passageway for enclosing a portion of the flexible electrical conductor.

13. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

wherein the ball of the ball-and-socket joint having a surface that is engaged by the socket that comprises an ultra-high-molecular-weight polyethylene.

14. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of a ball and a socket that form a ball-and-socket joint having an interference fit between the ball and the socket such that the positional relationship between the ball and socket is maintained when the only force acting on the ball-and-socket joint is gravity but allowing the positional relationship to be altered when an additional force is applied;

wherein the socket of the ball-and-socket joint having a surface that is engaged by the ball that comprises an ultra-high-molecular-weight polyethylene.

15. An antenna system comprising:

a first rigid antenna portion;

a second rigid antenna portion;

a flexible electrical conductor that extends between the first and second rigid antenna portions; and a connector extending from the first rigid antenna portion to the second rigid antenna portion, the connector comprised of:

a first link that is located between the first rigid antenna portion and the remainder of the connector, the first link comprising one of: a first ball and a first socket;

a second link that is located between the second rigid antenna portion and the remainder of the connector, the second link comprising one of: a second ball and second socket;

an intermediate link that is located between the first link and the second links, the intermediate link comprising one of: an intermediate ball and an intermediate socket rigidly joined to one another, two intermediate balls rigidly joined to one another; and two intermediate sockets rigidly joined to one another;

the connector having at least one ball-and-socket joint with an interference fit between the ball and the socket such that the positional relationship between the ball and socket is maintained when the only force acting on the ball-and-socket joint is gravity but allowing the positional relationship to be altered when an additional force is applied.

16. An antenna system, as claimed in claim 15, wherein:

the connector defining a passageway for enclosing a portion of the flexible electrical conductor.

17. An antenna system, as claimed in claim 15, wherein:

the passageway having a plurality of frusto-conical sections.

* * * * *